US012167754B2

(12) United States Patent
Liu

(10) Patent No.: US 12,167,754 B2
(45) Date of Patent: Dec. 17, 2024

(54) ATOMIZER AND ELECTRONIC CIGARETTE COMPRISING THE SAME

(71) Applicant: Shenzhen Eigate Technology Co., Ltd., Shenzhen (CN)

(72) Inventor: Tuanfang Liu, Shenzhen (CN)

(73) Assignee: SHENZHEN EIGATE TECHNOLOGY CO., LTD., Shenzhen (CN)

( * ) Notice: Subject to any disclaimer, the term of this patent is extended or adjusted under 35 U.S.C. 154(b) by 413 days.

(21) Appl. No.: 17/547,217

(22) Filed: Dec. 9, 2021

(65) Prior Publication Data

US 2022/0369718 A1 Nov. 24, 2022

(30) Foreign Application Priority Data

May 22, 2021 (CN) ..... 202110561313.4
May 22, 2021 (CN) ..... 202121114344.7

(51) Int. Cl.

| | |
|---|---|
| ***A24F 40/48*** | (2020.01) |
| ***A24F 40/10*** | (2020.01) |
| ***A24F 40/42*** | (2020.01) |
| ***A24F 40/46*** | (2020.01) |

(52) U.S. Cl.

CPC ..... *A24F 40/48* (2020.01); *A24F 40/10* (2020.01); *A24F 40/42* (2020.01); *A24F 40/46* (2020.01)

(58) Field of Classification Search

None

See application file for complete search history.

(56) References Cited

U.S. PATENT DOCUMENTS

2017/0360093 A1* 12/2017 Fernando ..... A24F 40/485

FOREIGN PATENT DOCUMENTS

WO WO-2015180088 A1 * 12/2015 ..... A24F 47/00
WO WO-2018171402 A1 * 9/2018 ..... A24F 47/008

OTHER PUBLICATIONS

WO2015180088 English translation obtained from Espacenet Mar. 14, 2024 (Year: 2024).*
WO2018171402 English translation obtained from Espacenet Mar. 14, 2024 (Year: 2024).*

* cited by examiner

*Primary Examiner* — Philip Y Louie
*Assistant Examiner* — Eric M Fierce
(74) *Attorney, Agent, or Firm* — MATTHIAS SCHOLL P.C.; Matthias Scholl

(57) ABSTRACT

An atomizer includes a main body. The main body includes an e-liquid chamber, a heating chamber, a heating element, and an e-liquid channel. The heating element is disposed in the heating chamber. The main body further includes at least one e-liquid inlet and at least one e-liquid outlet communicating with two ends of the e-liquid channel, respectively. The at least one e-liquid inlet is disposed in a bottom part of the e-liquid chamber. The at least one e-liquid outlet is connected to the heating chamber. The main body further includes a mouthpiece connected to and communicating with the heating chamber; when a user inhales smoke or vapor through the mouthpiece, the e-liquid is sucked from the e-liquid chamber into the e-liquid channel by a suction force, flows into the heating chamber.

13 Claims, 8 Drawing Sheets

ATOMIZER AND ELECTRONIC CIGARETTE COMPRISING THE SAME

CROSS-REFERENCE TO RELATED APPLICATIONS

Pursuant to 35 U.S.C.§ 119 and the Paris Convention Treaty, this application claims foreign priority to Chinese Patent Application No. 202110561313.4 filed May 22, 2021, and to Chinese Patent Application No. 202121114344.7 filed May 22, 2021. The contents of all of the aforementioned applications, including any intervening amendments thereto, are incorporated herein by reference. Inquiries from the public to applicants or assignees concerning this document or the related applications should be directed to: Matthias Scholl P. C., Attn.: Dr. Matthias Scholl Esq., 245 First Street, 18th Floor, Cambridge, MA 02142.

BACKGROUND

The disclosure relates to an atomizer and an electronic cigarette comprising the same.

Conventional atomizers include the e-liquid inlets through which the e-liquid flows into the heating elements for atomization. The heating elements are adjacent to the e-liquid inlets and in direct contact with the e-liquid. After a period of use, the e-liquid may corrode the heating elements, thus affecting the taste of the vapor or smoke and shortening the service life of the heating elements.

SUMMARY

The first objective of the disclosure is to provide an atomizer comprising a main body; the main body comprises an e-liquid chamber, a heating chamber, a heating element, and an e-liquid channel; the heating element is disposed in the heating chamber; the main body further comprises at least one e-liquid inlet and at least one e-liquid outlet communicating with two ends of the e-liquid channel, respectively; the at least one e-liquid inlet is disposed in a bottom part of the e-liquid chamber; the at least one e-liquid outlet is connected to the heating chamber; the main body further comprises a mouthpiece connected to and communicating with the heating chamber; when a user inhales smoke or vapor through the mouthpiece, the e-liquid is sucked from the e-liquid chamber into the e-liquid channel by a suction force, flows into the heating chamber.

In a class of this embodiment, the heating chamber is disposed above the e-liquid chamber and the e-liquid channel; the main body further comprises an e-liquid absorbent member disposed in the heating chamber and connected to the e-liquid outlet; and the e-liquid absorbent member comprises e-liquid absorbent cotton, cotton wool, composite cotton, linen cotton, ceramic, or a combination thereof.

In a class of this embodiment, the at least one e-liquid inlet comprises a distal end and a proximal end; the distal end is away from the e-liquid outlet and the proximal end is near the e-liquid outlet; an e-liquid conduction channel is formed on the distal end and communicates with the e-liquid channel; and the proximal end is connected to the e-liquid chamber.

In a class of this embodiment, the e-liquid channel is annular.

In a class of this embodiment, the main body further comprises an e-liquid conduction member disposed in the e-liquid chamber; the e-liquid conduction member comprises a hollow channel, a first flange, and a second flange; the first flange and the second flange are respectively disposed on both ends of the hollow channel; the first flange comprises a concave part; the at least one e-liquid inlet is disposed on the first flange to communicate with the hollow channel; the second flange comprises an edge and a plurality of notches disposed on the edge; each of the plurality of notches communicates with the e-liquid chamber; preferably, the second flange comprises four notches disposed on the edge, thus allowing external air to flow through the four notches into the e-liquid chamber and hence equalizing air pressure.

In a class of this embodiment, the concave part has a depth of 0.2-0.6 mm. Preferably, the depth of the concave part is 0.4 mm, which allows smooth flow of the e-liquid under negative pressure.

In a class of this embodiment, the main body further comprises a fixing member; the fixing member comprises a first concave portion and a first hollow column; the first concave portion comprises a bottom surface and the first hollow column is disposed in the middle of the bottom surface; and the first flange abuts against the bottom surface so that the first hollow column is disposed into the hollow channel.

In a class of this embodiment, the e-liquid conduction channel is formed between the concave part and the bottom surface of the fixing member.

In a class of this embodiment, the main body further comprises an e-liquid injection member; the e-liquid injection member comprises a bottom end and the bottom end is concave to form a second concave portion; the second concave portion comprises a top wall; the top wall comprises a second hollow column and the e-liquid outlet is disposed on the top wall; the second flange abuts against the top wall of the second concave portion so that the second hollow column is disposed through the hollow channel and connected to the first hollow column; an upper side of the e-liquid outlet is connected to the heating element; and a lower side of the e-liquid outlet is connected to the e-liquid channel.

In a class of this embodiment, an annular channel is defined by an inner wall of the e-liquid conduction member, an outer wall of the first hollow column, and an outer wall of the second hollow column; and the annular channel functions as the e-liquid channel.

In a class of this embodiment, the main body further comprises an e-liquid storage member comprising an e-liquid passage; one end of the e-liquid storage member abuts against the fixing member and the other end of the e-liquid storage member abuts against the bottom end of the e-liquid injection member; the e-liquid chamber is defined by the first concave portion, the e-liquid passage, and the second concave portion; and the e-liquid chamber is around the e-liquid conduction member.

In a class of this embodiment, the e-liquid injection member comprises an outer wall comprising at least one first through hole; the at least one first through hole communicates with the e-liquid chamber, thus allowing the e-liquid to be injected from an e-liquid bottle to the e-liquid chamber.

In a class of this embodiment, the at least one first through hole has a diameter of 3-6 mm, preferably 3-4 mm, and more preferably 3.4 mm.

In a class of this embodiment, the liquid injection member further comprises a top end and a first electrode disposed on the top end; the first electrode is formed integrally with the liquid injection member; the main body further comprises an insulating member and a conductive part disposed in the insulating member; the insulating member is configured to isolate the conductive part and the e-liquid injection member; the conductive part further comprises a top portion and a second electrode disposed on the top portion; the second electrode is formed integrally with the conductive part; the first electrode and the second electrode are electrically connected to both ends of the heating element, respectively, to allow for convenient connection and disconnection of the heating element and the two electrodes.

In a class of this embodiment, the conductive part further comprises a bottom portion comprising a third hollow column; the third hollow column extends from the middle of the bottom portion into the second hollow column; and the heating element is disposed on the e-liquid absorbent member.

In a class of this embodiment, the main body further comprises an atomizing member comprising the heating chamber; the top end of the e-liquid injection member is disposed in the bottom of the atomizing member so that the heating element is disposed in the heating chamber.

In a class of this embodiment, the atomizing member further comprises a side wall comprising at least one second through hole; the at least one second through hole communicates with the heating chamber; the heating element and the e-liquid absorbent member occupies three-fifths to four-fifths of the volume of the heating chamber, preferably two-thirds to three-fourths; the heating chamber is filled with the e-liquid with leaving a gap for air flow, which facilitates the absorption of the e-liquid, thus increasing the amount of vapor or smoke.

In a class of this embodiment, the main body further comprises an airflow regulator disposed on the atomizing member; the airflow regulator comprises a side wall comprising at least one air inlet; the at least one air inlet is opposite to the at least one second through hole and the heating element; the airflow regulator is configured to rotate around the outer wall of the atomizing member so as to regulate the amount of air flowing out of the atomizer; the mouthpiece is disposed on a top end of the atomizing member and comprises a cavity communicating with the heating chamber; preferably, the number of the at least one air inlet or the at least one second through hole is four, which prevents excessive smoke and allows smooth flow of the e-liquid under negative pressure; the mouthpiece is one end from which user inhales; the at least one air inlet and the at least one second through hole are directly opposite to the heating element, which allows for smooth flow of the air flow.

In a class of this embodiment, the outer diameter of the at least one air inlet is larger than the inner diameter thereof, which facilitates air intake, smoke emission, and e-liquid transport.

The disclosure also provides an electronic cigarette comprising the aforesaid atomizer and a battery assembly.

The following advantages are associated with the atomizer and the electronic cigarette of the disclosure: the atomizer comprises the e-liquid channel configured to conduct the e-liquid into the heating element for atomization; and the e-liquid is sucked by users and transferred into the heating element, which enhances user experience.

Figure 1:
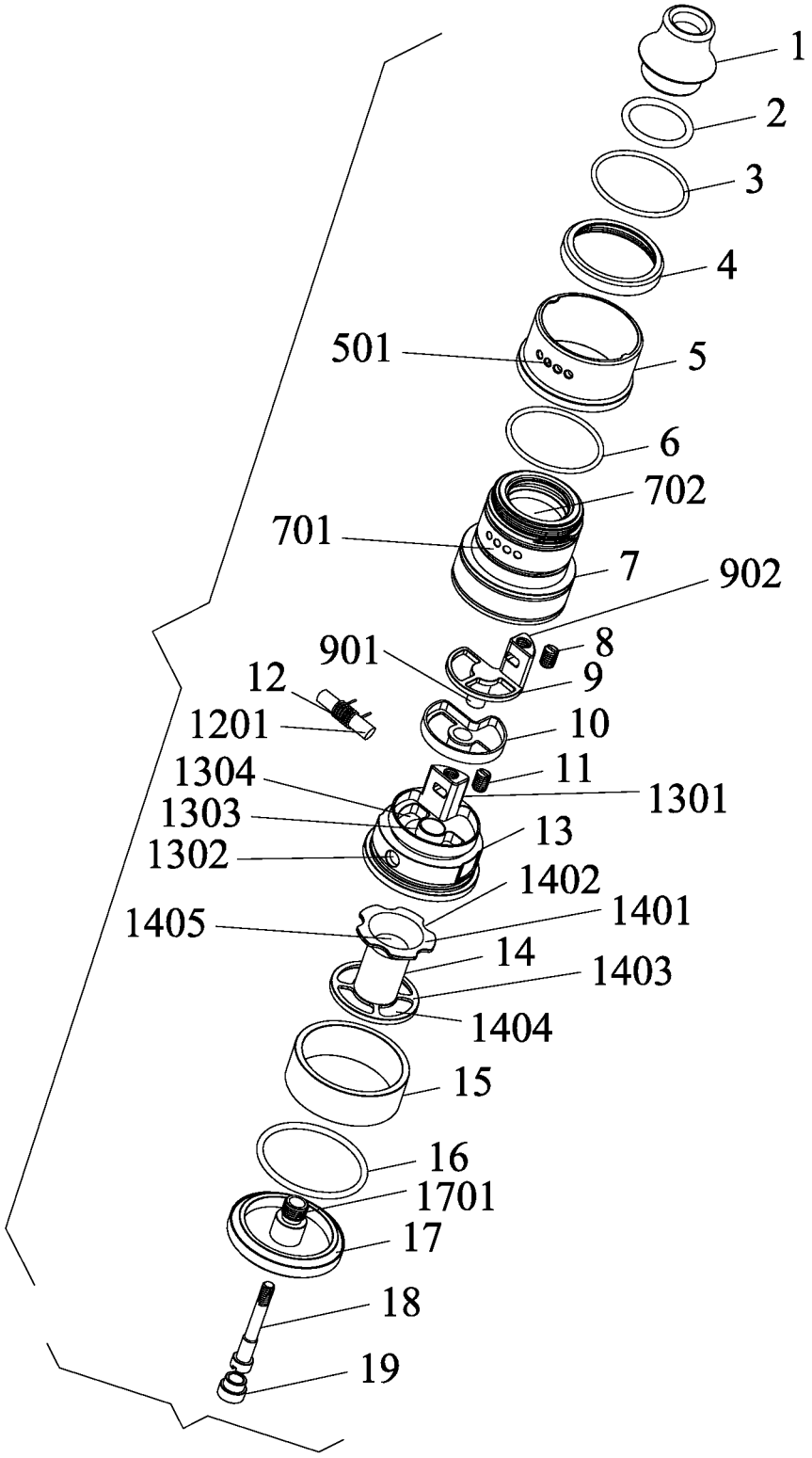
FIG. 1 is an exploded view of an atomizer according to one embodiment of the disclosure.
Figure 2:
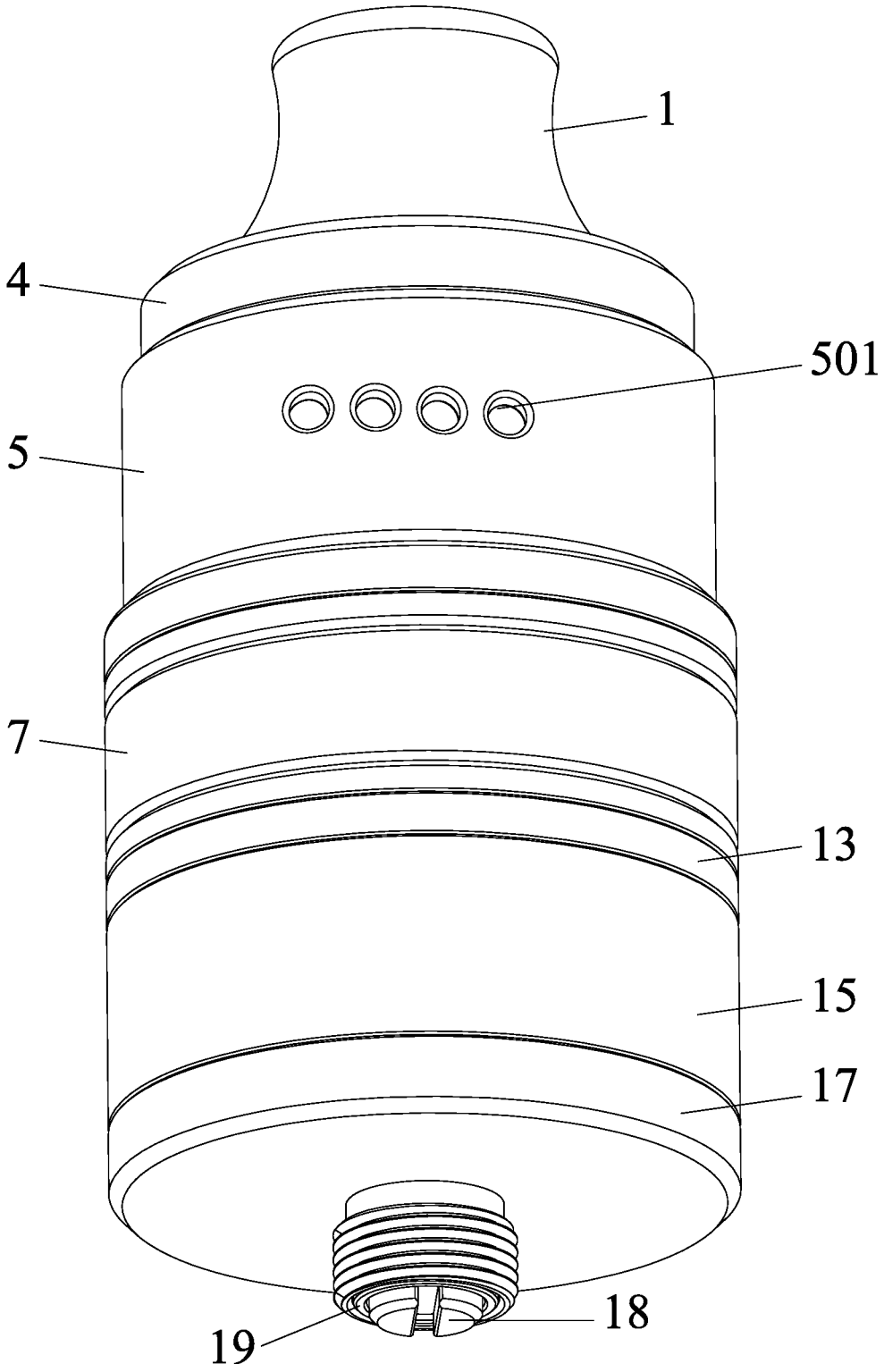
FIG. 2 is a perspective view of an atomizer according to one embodiment of the disclosure.
Figure 3:
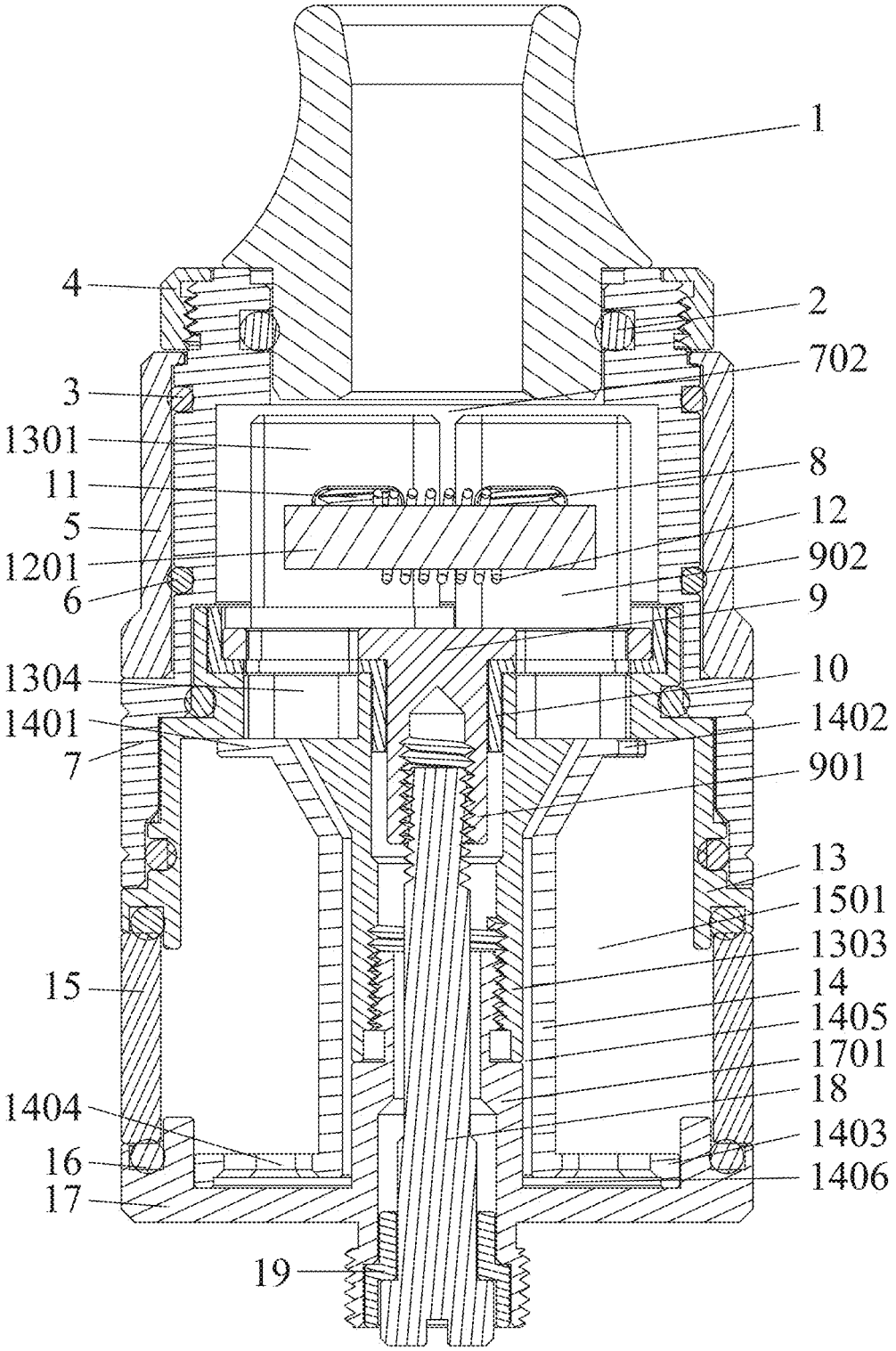
FIG. 3 is a front view of an atomizer according to one embodiment of the disclosure.
Figure 4:
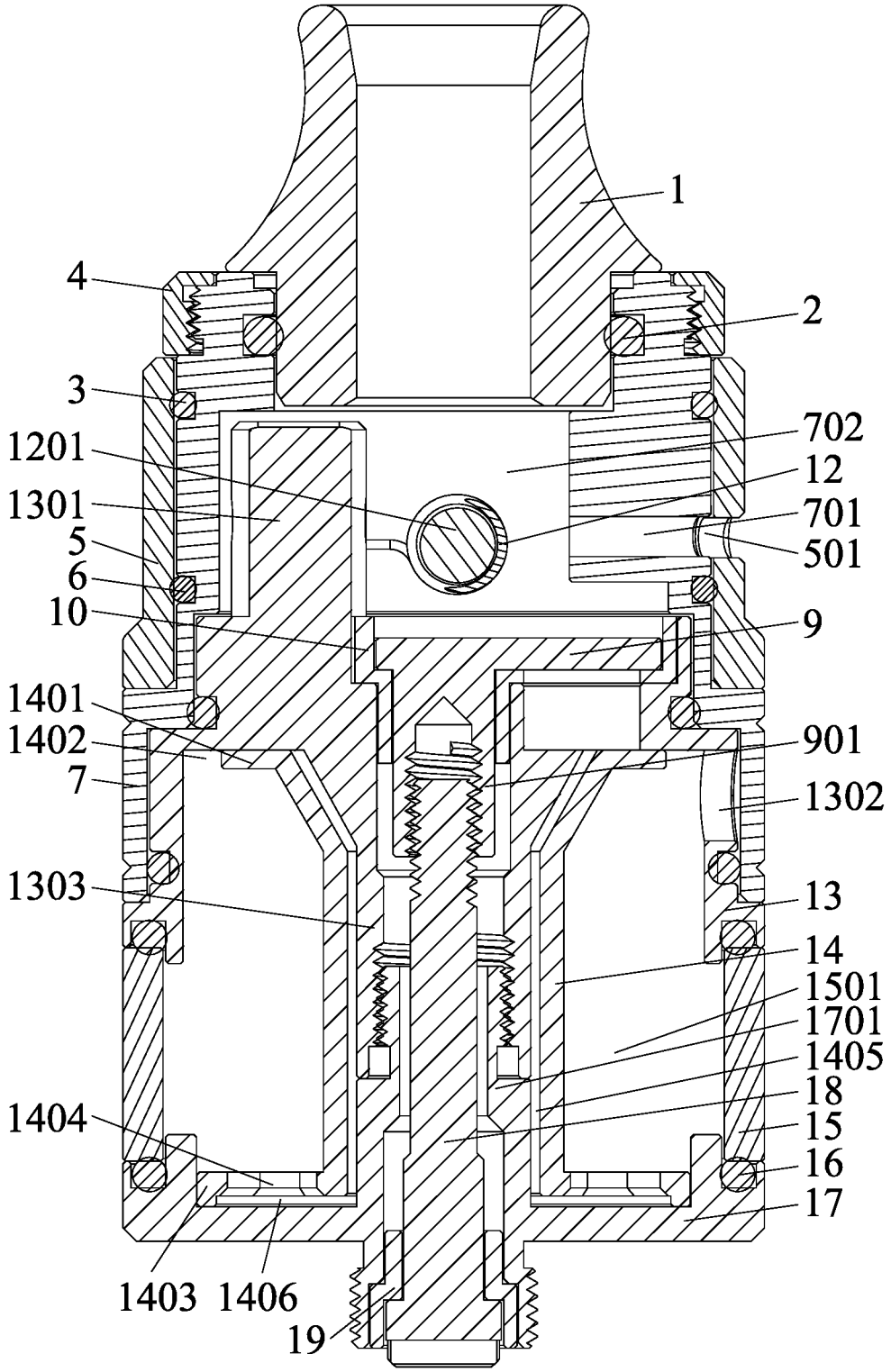
FIG. 4 is a left side view of an atomizer according to one embodiment of the disclosure.
Figure 5:
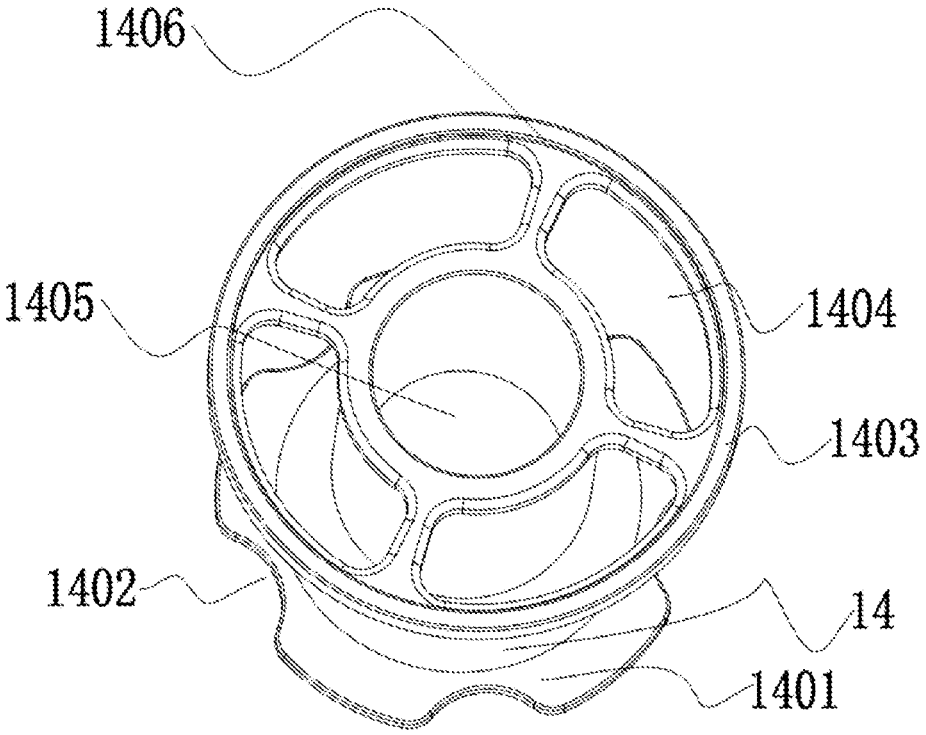
FIG. 5 is a bottom view of a liquid conduction member according to one embodiment of the disclosure.
Figure 6:
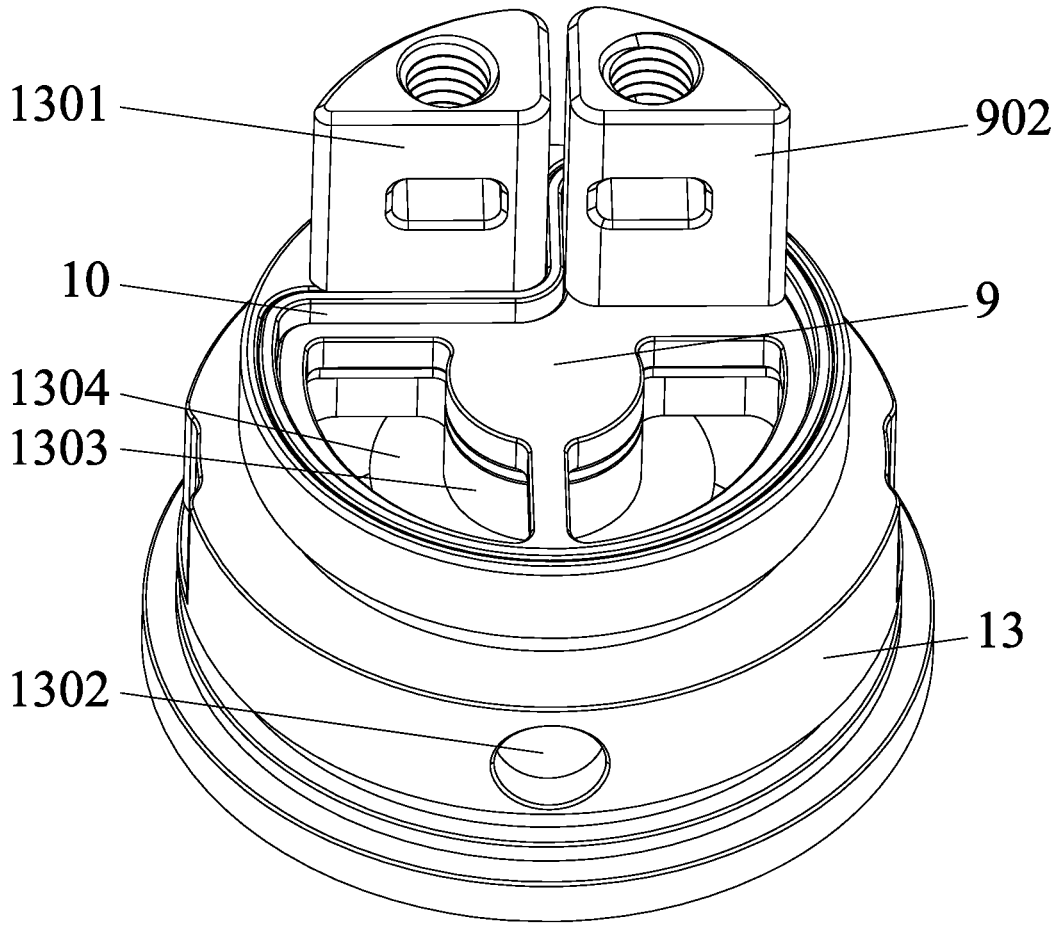
FIG. 6 is a perspective view of a combination of a conductive part, an insulating member, and an e-liquid injection member according to one embodiment of the disclosure.

In the drawings, the following reference numbers are used: 1. Mouthpiece; 2. First seal; 3. Second seal; 4. Locating piece; 5. Airflow regulator; 6. Third seal; 7. Atomizing member; 8. First screw; 9. Conductive part; 10. Insulating member; 11. Second screw; 12. Heating element; 13. Liquid injection member; 14. Liquid conduction member; 15. E-liquid storage member; 16. Fourth seal; 17. Fixing member; 18. Electrode connector; 19. Separator; 501. Air inlet; 701. Second through hole; 702. Heating chamber; 901. Third hollow column; 902. Second electrode; 1201. E-liquid absorbent member; 1301. First electrode; 1302. First through hole; 1303. Second hollow column; 1304. E-liquid outlet; 1401. Second flange; 1402. Notch; 1403. First flange; 1405. Hollow channel; 1406. Concave part; 1501. E-liquid chamber; and 1701. First hollow column.

DETAILED DESCRIPTION

To further illustrate the disclosure, embodiments detailing an atomizer and an electronic cigarette of the disclosure are described below. It should be noted that the following embodiments are intended to describe and not to limit the disclosure.

An atomizer comprises a main body. The main body comprises an e-liquid chamber 1501, a heating chamber 702, a heating element 12, and an e-liquid channel. The heating element 12 is disposed in the heating chamber 702. The main body further comprises at least one e-liquid inlet 1404 and at least one e-liquid outlet 1304 disposed in the e-liquid channel. The at least one e-liquid inlet 1404 is disposed in a bottom part of the e-liquid chamber 1501. The e-liquid outlet 1304 is connected to the heating chamber 702. The main body comprises a mouthpiece communicating with the heating chamber 702. When a user inhales from the mouthpiece, the e-liquid is sucked from the e-liquid channel and transferred into the heating chamber.

The heating chamber 702 is disposed above the e-liquid chamber 1501 and the e-liquid channel. The main body further comprises an e-liquid absorbent member 1201 disposed in the heating chamber 702 and connected to the e-liquid outlet 1304. The e-liquid absorbent member 1201 comprises e-liquid absorbent cotton, cotton wool, composite cotton, linen cotton, or ceramic. Preferably, the e-liquid absorbent member 1201 comprises e-liquid absorbent cotton that absorbs the e-liquid and expands to fill the heating chamber 702.

The at least one e-liquid inlet comprises a distal end and a proximal end; the distal end is away from the e-liquid outlet and the proximal end is near the e-liquid outlet; an e-liquid conduction channel is formed on the distal end and communicates with the e-liquid channel; and the proximal end is connected to the e-liquid chamber 1501.

The e-liquid channel is annular.

The main body further comprises an e-liquid conduction member 14 disposed in the e-liquid chamber 1501. The e-liquid conduction member 14 comprises a hollow channel 1405, a first flange 1403, and a second flange 1401. The first flange 1403 and the second flange 1401 are disposed on both ends of the hollow channel 1405. The first flange 1403 comprises a concave part 1406. The at least one e-liquid inlet 1404 is disposed on the first flange 1403 to communicate with the hollow channel 1405. The second flange 1401 comprises an edge and a plurality of notches 1402 disposed on the edge. Each of the plurality of notches 1402 communicates with the e-liquid chamber 1501. In the example, the second flange 1401 comprises four notches 1402 disposed on the edge, thus allowing external air to flow through the four notches 1402 into the e-liquid chamber 1501 and hence equalizing air pressure.

The concave part 1406 has a depth of 0.2-0.6 mm. Preferably, the depth of the concave part 1406 is 0.4 mm, which allows smooth flow of the e-liquid under negative pressure.

The main body further comprises a fixing member 17. The fixing member 17 comprises a first concave portion and a first hollow column 1701. The first concave portion comprises a bottom surface and the first hollow column 1701 is disposed in the middle of the bottom surface. The first flange 1403 abuts against the bottom surface so that the first hollow column 1701 is disposed into the hollow channel 1405.

The e-liquid conduction channel is formed between the concave part 1406 and the bottom surface of the fixing member 17.

The main body further comprises an e-liquid injection member 13. The e-liquid injection member 13 comprises a bottom end and the bottom end is concave to form a second concave portion. The second concave portion comprises a top wall. The top wall comprises a second hollow column 1303 and the e-liquid outlet 1304. The second flange 1401 abuts against the top wall of the second concave portion so that the second hollow column 1303 is disposed through the hollow channel 1405 and connected to the first hollow column 1701. An upper side of the e-liquid outlet 1304 is connected to the heating element 12. A lower side of the e-liquid outlet 1304 is connected to the e-liquid channel.

The e-liquid channel is defined by an inner wall of the e-liquid conduction member 14, an outer wall of the first hollow column 1701, and an outer wall of the second hollow column 1303.

The main body further comprises an e-liquid storage member 15 comprising an e-liquid passage. One end of the e-liquid storage member 15 abuts against the fixing member 17 and the other end of the e-liquid storage member 15 abuts against the bottom end of the e-liquid injection member 13. The e-liquid chamber 1501 is defined by the first concave portion, the e-liquid passage, and the second concave portion. The e-liquid chamber 1501 is around the e-liquid conduction member 14.

The e-liquid injection member 13 comprises an outer wall comprising at least one first through hole 1302. The at least one first through hole 1302 communicates with the e-liquid chamber 1501, thus allowing the e-liquid to be injected from an e-liquid bottle to the e-liquid chamber 1501. In the example, the e-liquid injection member 13 comprises only one first through hole 1302, which offers advantages that can reduce the cost and prevent leakage of the e-liquid.

The at least one first through hole 1302 has a diameter of 3-6 mm, preferably 3-4 mm, and more preferably 3.4 mm. The liquid injection member 13 further comprises a top end and a first electrode 1301 disposed on the top end. The first electrode 1301 is formed integrally with the liquid injection member 13. The main body further comprises an insulating member 10 and a conductive part 9 disposed in the insulating member 10. The insulating member 10 is configured to isolate the conductive part 9 and the e-liquid injection member 13. The conductive part 9 further comprises a top portion and a second electrode 902 disposed on the top portion. The second electrode 902 is formed integrally with the conductive part 9. The first electrode 1301 and the second electrode 902 are electrically connected to both ends of the heating element 12, respectively, to allow for convenient connection and disconnection of the heating element 12 and the two electrodes 1301, 902.

The conductive part 9 further comprises a bottom portion comprising a third hollow column 901. The third hollow column 901 extends from the middle of the bottom portion into the second hollow column 1303. The heating element 12 is disposed on the e-liquid absorbent member 1201. The liquid injection member 13 and the conductive part 9 separately comprise conductive materials and function as electrodes for conducting electricity.

The main body further comprises an atomizing member 7 comprising the heating chamber 702. The top end of the e-liquid injection member 13 is disposed in the bottom part of the atomizing member 7 so that the heating element 12 is disposed in the heating chamber 702.

The atomizing member 7 further comprises a side wall comprising at least one second through hole 701. The at least one second through hole 701 communicates with the heating chamber 702. The heating element 12 and the e-liquid absorbent member 1201 occupies three-fifths to four-fifths of the volume of the heating chamber 702, preferably two-thirds to three-fourths. The heating chamber 702 is filled with the e-liquid with leaving a gap for air flow, which facilitates the absorption of the e-liquid, thus increasing the amount of vapor or smoke.

The main body further comprises an airflow regulator 5 disposed on the atomizing member 7. The airflow regulator 5 comprises a side wall comprising at least one air inlet 501. The at least one air inlet 501 is opposite to the at least one second through hole 701 and the heating element 12. The airflow regulator 5 is configured to rotate around the outer wall of the atomizing member 7 so as to regulate the amount of air flowing out of the atomizer. The mouthpiece 1 is disposed on a top end of the atomizing member 7 to communicate with the heating chamber 702. Preferably, the number of the at least one air inlet 501 or the at least one second through hole 701 is four, which prevents excessive smoke and allows smooth flow of the e-liquid under negative pressure. The mouthpiece 1 is one end from which user inhales. The at least one air inlet 501 and the at least one second through hole 701 are directly opposite to the heating element 12, which allows for smooth flow of the air flow.

The at least one air inlet 501 has an inside diameter and an outside diameter greater than the inside diameter, which facilitates air intake, smoke emission, and e-liquid transport.

Referring to FIGS. 1-6, the atomizer comprises the mouthpiece 1, a first seal 2, a second seal 3, a locating piece 4, the airflow regulator 5, the third seal 6, the atomizing member 7, a first screw 8, the conductive part 9, the insulating member 10, a second screw 11, the heating element 12, the liquid injection member 13, the e-liquid conduction member 14, the e-liquid storage member 15, a fourth seal 16, the fixing member 17, an electrode connector 18, and a separator 19. The e-liquid conduction member 14 comprises the hollow channel 1405, the first flange 1403, and the second flange 1401. The first flange 1403 and the second flange 1401 are disposed on both ends of the hollow channel 1405. The first flange 1403 comprises a concave part 1406. The at least one e-liquid inlet 1404 is disposed on the first flange 1403 to communicate with the hollow channel 1405. The second flange 1401 comprises an edge and five notches 1402 disposed on the edge. Each of the five notches 1402 communicates with the e-liquid chamber 1501 for e-liquid conduction. The fixing member 17 comprises a first concave portion and a first hollow column 1701. The first concave portion comprises a bottom surface and the first hollow column 1701 is disposed in the middle of the bottom surface. The first flange 1403 abuts against the bottom surface so that the first hollow column 1701 is disposed into the hollow channel 1405. The e-liquid injection member comprises a bottom end and the bottom end is concave to form a second concave portion. The second concave portion comprises a top wall. The top wall comprises a second hollow column and the e-liquid outlet. The second flange 1401 abuts against the top wall of the second concave portion so that the second hollow column 1303 is disposed through the hollow channel 1405 and connected to the first hollow column 1701. An e-liquid channel is defined by the inner wall of the e-liquid conduction member 14, the outer wall of the first hollow column 1701, and the outer wall of the second hollow column 1303. The lower side of the e-liquid outlet 1304 is connected to the e-liquid channel. The upper side of the e-liquid outlet 1304 is connected to the heating element 12. The e-liquid flows from the e-liquid channel through the e-liquid outlet 1304 and enters the heating element 12. The fixing member 17 further comprises a second concave part. The fourth seal 16 is fixedly disposed between the concave part 1406 and the second concave part. One end of the e-liquid storage member 15 abuts against the fixing member 17 and the other end of the e-liquid storage member 15 abuts against the bottom end of the e-liquid injection member 13. The e-liquid chamber 1501 is defined by the first concave portion, the e-liquid storage member 15, and the second concave portion. The e-liquid injection member 13 comprises the outer wall comprising at least one first through hole 1302. The at least one first through hole 1302 communicates with the e-liquid chamber 1501, thus allowing the e-liquid to be injected into the e-liquid chamber 1501. The liquid injection member 13 further comprises a top end and a first electrode 1301 disposed on the top end. The first electrode 1301 is formed integrally with the liquid injection member 13. The heating element 12 comprises a positive pin and a negative pin. The first electrode is electrically connected to the negative pin. The insulating member 10 is disposed on the e-liquid injection member 13 and the conductive part 9 disposed in the insulating member 10. The insulating member 10 is configured to isolate the conductive part 9 and the e-liquid injection member 13. The conductive part 9 further comprises a top portion and a second electrode 902 disposed on the top portion. The second electrode 902 is formed integrally with the conductive part 9. The first electrode is electrically connected to the positive pin. The positive pin is fixedly disposed on the first electrode 1301 by the first screw 8. The negative pin is fixedly disposed on the second electrode by the second screw 11. The conductive part 9 further comprises the bottom portion comprising the third hollow column 901. The third hollow column 901 extends from the middle of the bottom portion into the second hollow column 1303. The liquid injection member 13 and the conductive part 9 separately comprise conductive materials and function as electrodes for conducting electricity. The atomizing member 7 comprises the heating chamber 702 configured to accumulate the smoke produced from burning the e-liquid in the heating element 12. The top end of the e-liquid injection member 13 is disposed in the bottom part of the atomizing member 7 so that the heating element 12 is disposed in the heating chamber 702. The atomizing member 7 further comprises the side wall comprising one second through hole 701. The second through hole 701 communicates with the heating chamber 702. The second seal 3 and the third seal 6 are separately disposed on both ends of the atomizing member 7, respectively, to seal the gap between the airflow regulator 5 and the atomizing member 7. The airflow regulator 5 is disposed on the atomizing member 7. The at least one air inlet 501 is opposite to the at least one second through hole 701. The airflow regulator 5 is configured to rotate around the outer wall of the atomizing member 7 so as to regulate the amount of air flowing out of the atomizer. The first seal 2 is disposed between the mouthpiece 1 and an upper end of the atomizing member 7 to prevent changes in position of the mouthpiece 1. The mouthpiece 1 is disposed on a top end of the atomizing member 7 to communicate with the heating chamber 702. The atomizing member 7 comprises a male thread and the locating piece 4 comprises a female thread. The male thread is screwed to the female thread so that the airflow regulator 5 is fixedly disposed on the atomizing member 7.

Figure 7:
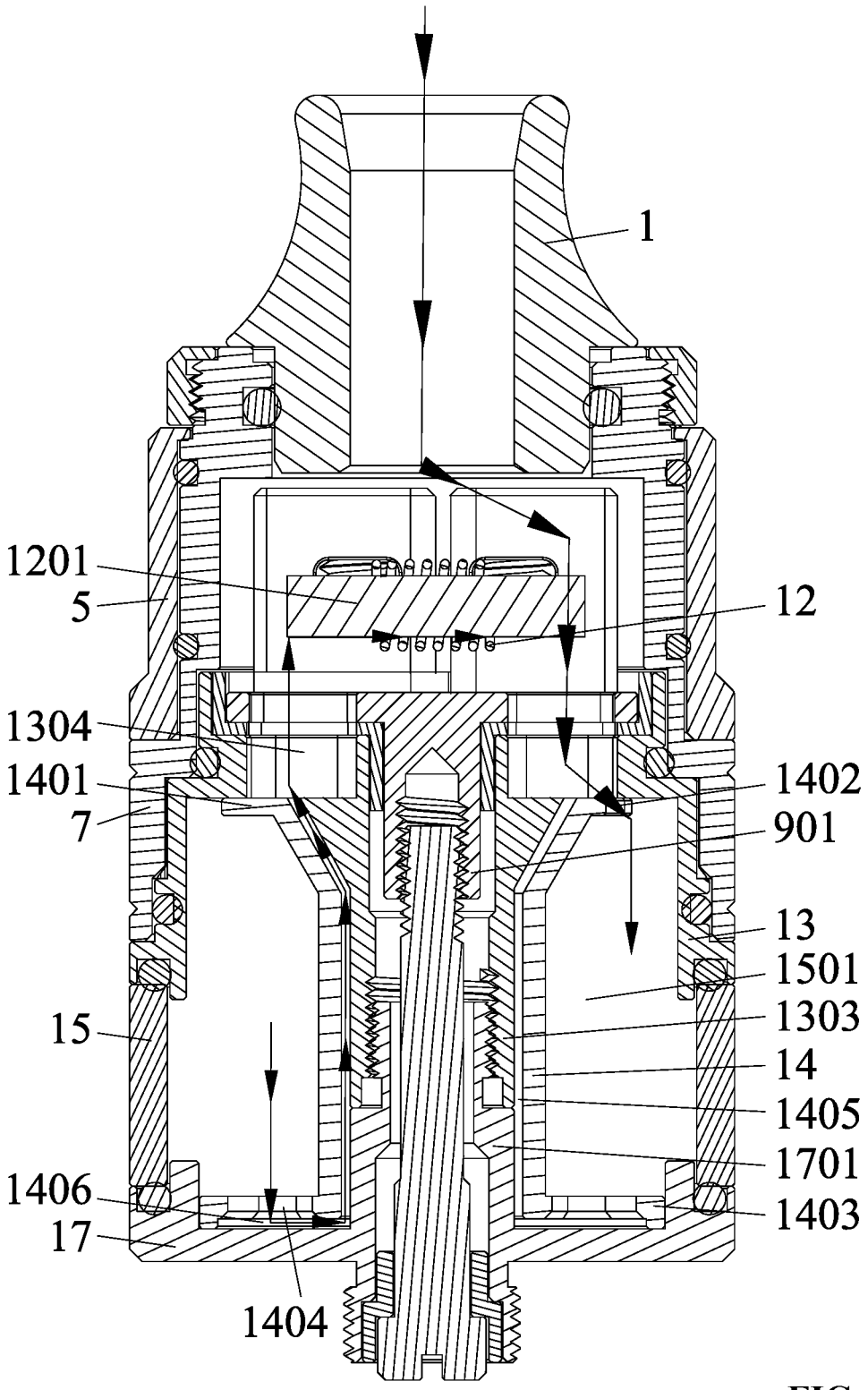
FIG. 7 is a cross-sectional view including arrows showing the direction of e-liquid in an atomizer according to one embodiment of the disclosure.

Referring to FIG. 7, the working principle of the atomizer is detailed as follows: when a user inhales from the mouthpiece 1, the e-liquid is sucked from the e-liquid chamber 1501 through the at least one e-liquid inlet 1404 and enters the e-liquid channel. Then the e-liquid flows through the e-liquid outlet 1304 into the heating element 12 and is atomized to produce vapor or smoke. After atomization, external air flows through the mouthpiece 1, the heating chamber 702, and the plurality of notches 1402 successively, and enters the e-liquid chamber 1501 to equalize the pressure in the atomizer with the outside pressure.

Figure 8:
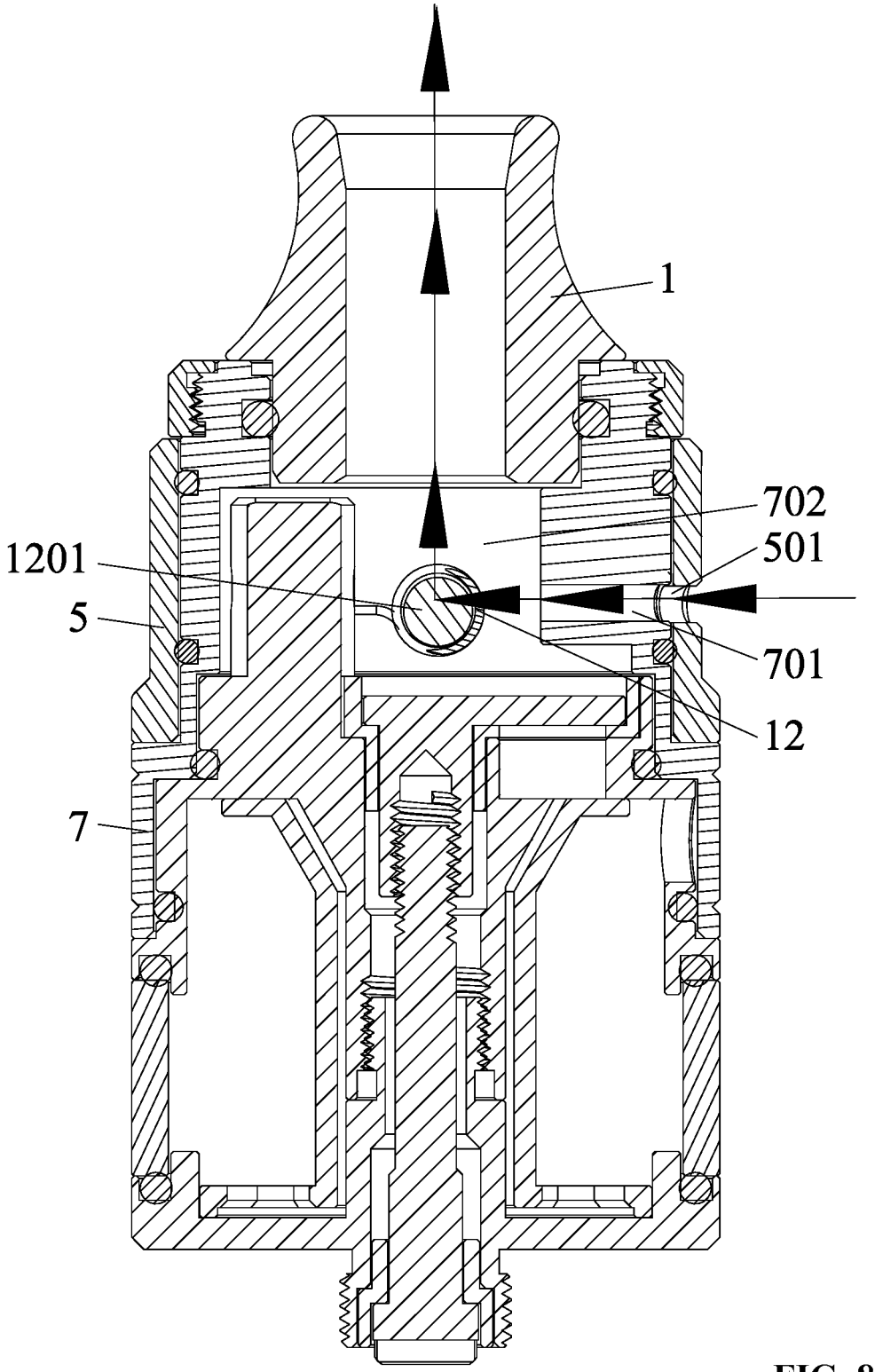
FIG. 8 is a cross-sectional view including arrows showing the direction of air flow in an atomizer according to one embodiment of the disclosure.

FIG. 8 is a cross-sectional view including arrows showing the direction of the air flow in the atomizer of the disclosure. External air flows through the at least one air inlet 501 and the at least one second through hole 701 successively, and enters the heating chamber 702, causing the heating element 12 to atomize the e-liquid. Then the smoke generated flows through the mouthpiece 1 and is inhaled by the user.

It will be obvious to those skilled in the art that changes and modifications may be made, and therefore, the aim in the appended claims is to cover all such changes and modifications.

The invention claimed is:

1. An atomizer, comprising a main body; wherein:

the main body comprises an e-liquid chamber, a heating chamber, a heating element, and an e-liquid channel;

the heating element is disposed in the heating chamber;

the main body further comprises at least one e-liquid inlet and at least one e-liquid outlet communicating with two ends of the e-liquid channel, respectively;

the at least one e-liquid inlet is disposed in a bottom part of the e-liquid chamber;

the at least one e-liquid outlet is connected to the heating chamber;

the main body further comprises a mouthpiece connected to and communicating with the heating chamber; when a user inhales smoke or vapor through the mouthpiece, e-liquid is sucked from the e-liquid chamber into the e-liquid channel by a suction force, flows into the heating chamber; and the at least one e-liquid inlet comprises a distal end and a proximal end; the distal end is away from the e-liquid outlet with respect to the proximal end, and the proximal end is adjacent to the e-liquid outlet with respect to the distal end; an e-liquid conduction channel is formed on the distal end and communicates with the e-liquid channel; and the proximal end is connected to the e-liquid chamber.

2. The atomizer of claim 1, wherein the heating chamber is disposed above the e-liquid chamber and the e-liquid channel; the main body further comprises an e-liquid absorbent member disposed in the heating chamber and connected to the e-liquid outlet.

3. The atomizer of claim 1, wherein the e-liquid channel is annular.

4. The atomizer of claim 3, wherein the main body further comprises an e-liquid conduction member disposed in the e-liquid chamber; the e-liquid conduction member comprises a hollow channel, a first flange, and a second flange; the first flange and the second flange are respectively disposed on both ends of the hollow channel; the first flange comprises a concave part; the at least one e-liquid inlet is disposed on the first flange to communicate with the hollow channel; the second flange comprises an edge and a plurality of notches disposed on the edge; each of the plurality of notches communicates with the e-liquid chamber.

5. The atomizer of claim 4, wherein the concave part has a depth of 0.2-0.6 mm.

6. The atomizer of claim 4, wherein the main body further comprises a fixing member; the fixing member comprises a first concave portion and a first hollow column; the first concave portion comprises a bottom surface and the first hollow column is disposed in the middle of the bottom surface; and the first flange abuts against the bottom surface so that the first hollow column is disposed into the hollow channel; and the e-liquid conduction channel is formed between the concave part and the bottom surface of the fixing member.

7. The atomizer of claim 5, wherein the main body further comprises an e-liquid injection member; the e-liquid injection member comprises a bottom end and the bottom end is concave to form a second concave portion; the second concave portion comprises a top wall; the top wall comprises a second hollow column and the e-liquid outlet is disposed on the top wall; the second flange abuts against the top wall of the second concave portion so that the second hollow column is disposed through the hollow channel and connected to the first hollow column; an upper side of the e-liquid outlet is connected to the heating element; and a lower side of the e-liquid outlet is connected to the e-liquid channel; and an annular channel is defined by an inner wall of the e-liquid conduction member, an outer wall of the first hollow column, and an outer wall of the second hollow column; and the annular channel functions as the e-liquid channel.

8. The atomizer of claim 7, wherein the main body further comprises an e-liquid storage member comprising an e-liquid passage; one end of the e-liquid storage member abuts against the fixing member and the other end of the e-liquid storage member abuts against the bottom end of the e-liquid injection member; the e-liquid chamber is defined by the first concave portion, the e-liquid passage, and the second concave portion; and the e-liquid chamber is around the e-liquid conduction member.

9. The atomizer of claim 8, wherein the e-liquid injection member comprises an outer wall comprising at least one first through hole; the at least one first through hole communicates with the e-liquid chamber; and the at least one first through hole has a diameter of 3-6 mm.

10. The atomizer of claim 9, wherein the liquid injection member further comprises a top end and a first electrode disposed on the top end; the first electrode is formed integrally with the liquid injection member; the main body further comprises an insulating member and a conductive part disposed in the insulating member; the insulating member is configured to isolate the conductive part and the e-liquid injection member; the conductive part further comprises a top portion and a second electrode disposed on the top portion; the second electrode is formed integrally with the conductive part; the first electrode and the second electrode are electrically connected to both ends of the heating element, respectively; and the conductive part further comprises a bottom portion comprising a third hollow column; the third hollow column extends from the middle of the bottom portion into the second hollow column; and the heating element is disposed on the e-liquid absorbent member.

11. The atomizer of claim 10, wherein the main body further comprises an atomizing member comprising the heating chamber; the top end of the e-liquid injection member is disposed in a bottom of the atomizing member so that the heating element is disposed in the heating chamber; and the atomizing member further comprises a side wall comprising at least one second through hole; the at least one second through hole communicates with the heating chamber; the heating element and the e-liquid absorbent member occupies three-fifths to four-fifths of the volume of the heating chamber.

12. The atomizer of claim 11, wherein the main body further comprises an airflow regulator disposed on the atomizing member; the airflow regulator comprises a side wall comprising at least one air inlet; the at least one air inlet is opposite to the at least one second through hole and the heating element; the airflow regulator is configured to rotate around the outer wall of the atomizing member so as to regulate the amount of air flowing out of the atomizer; the mouthpiece is disposed on a top end of the atomizing member and comprises a cavity communicating with the heating chamber; and an outer diameter of the at least one air inlet is larger than an inner diameter thereof.

13. An electronic cigarette, comprising the atomizer of claim 1 and a battery assembly.

* * * * *